US005447468A

United States Patent [19]

Tener et al.

[11] Patent Number: 5,447,468

[45] Date of Patent: Sep. 5, 1995

[54] FUME HOOD

[75] Inventors: Duane S. Tener, Independence, Mo.; Paul H. Morphy, Prairie Village; Kevin C. Gilkison, Olathe, both of Kans.

[73] Assignee: Labconco Corporation, Kansas City, Mo.

[21] Appl. No.: 171,104

[22] Filed: Dec. 21, 1993

[51] Int. Cl.[6] ..... B08B 15/02

[52] U.S. Cl. ..... 454/58; 49/102; 454/56

[58] Field of Search ..... 454/56, 57, 58, 59, 454/62, 324, 334; 49/65, 102

[56] References Cited

U.S. PATENT DOCUMENTS

| | | | |
|---|---|---|---|
| 2,312,272 | 2/1943 | Stacey, Jr. | 454/324 X |
| 2,715,359 | 8/1955 | Mackintosh et al. | 454/62 X |
| 2,810,337 | 10/1957 | Samuelson et al. | 454/56 |
| 3,593,646 | 7/1971 | Hauville | 454/56 |
| 3,726,206 | 4/1973 | Worick, Jr. | 454/56 |

FOREIGN PATENT DOCUMENTS

| | | | |
|---|---|---|---|
| 17529 | of 1905 | United Kingdom | 454/56 |
| 324457 | 12/1971 | U.S.S.R. | 454/56 |

*Primary Examiner*—Harold Joyce
*Attorney, Agent, or Firm*—Shook, Hardy & Bacon

[57] ABSTRACT

A fume hood for venting fumes comprising a cabinet, a venting system, and a split sash. The cabinet defines a working area. The cabinet has a front face which comprises an opening for providing access to the working area. The venting system is connected to the cabinet and vents fumes that collect in the working area of the cabinet. A split sash is movably secured to the front face of the cabinet for selectively opening and closing the opening to the working area of the cabinet. The split sash comprises at least two panels that move in unison between closed and open positions. Further, the fume hood comprises a bypass having an opening formed in the face of the cabinet for controlling the face velocity of the cabinet and means for selectively adjusting the size of the bypass opening.

8 Claims, 4 Drawing Sheets

9.
92
180
36
88
86
30
90
134
122
130
136
34
9.

18
130
124
136
122
120
134
10
130
124
136
26
34
2

8.
7.
81
74
94
130
102
86
84
96
8.
32
106
112
110
70
72
106
16
108
34
2
26
18
120
134
122
136
124
130
120
10

FUME HOOD

FIELD OF THE INVENTION

This invention relates to laboratory work cabinets, and, more particularly, to an improved fume hood which provides greater control of the face velocity of the fume hood.

BACKGROUND OF THE INVENTION

Enclosed work cabinets for laboratories employing exhaust fans for removing undesirable and dangerous fumes are well known in the laboratory construction industry. An example of such a fume hood is shown in U.S. Pat. No. 4,534,281 which is owned by the Applicant herein.

Prior art fume hoods generally comprise a cabinet which defines an enclosed working area. The cabinet has an opening for providing access to the working area, and typically includes a door movable between open and closed positions to provide selective access to the working area. The prior art fume hoods also include an exhaust system, which is typically connected to the top of the cabinet, for venting fumes that collect in the working area of the cabinet.

Such prior art fume hoods also typically incorporate a bypass located in the face of the cabinet above the opening to the cabinet. The bypass allows air to be drawn through the fume hood via the bypass when the door to the fume hood is moved from the open to the closed position. Thus, the bypass maintains the face velocity of the fume hood at a substantially constant value.

A problem associated with the prior art fume hoods concerns the undesirable interaction between the door to the fume hood and the bypass. Prior art doors typically comprise a single panel which moves vertically upward from the closed to the fully open position. One problem associated with such an arrangement is that the bypass becomes blocked off completely after the door is moved only a short distance from the closed toward the open position. To provide convenient access to the working area, the door must be moved further in the upward direction, thereby increasing the size of the opening to the working area. However, since the bypass is blocked by the door panel, further upward movement decreases the face velocity of the fume hood and presents a threat that toxic fumes will escape the fume hood through the opening, thereby endangering persons working in the vicinity of the fume hood in the laboratory.

One solution to this problem is to move the bypass farther upwardly on the face of the fume hood so that more upward door movement is required to fully cover the bypass. However, such a design requires an increase in the height of the fume hood, and many laboratories do not have sufficient ceiling height to accommodate taller fume hoods. Likewise, the single door panel construction typically does not allow the door panel to be raised to the fully open position because the door contacts the ceiling of the laboratory before the fully open position is reached. Thus, complete access to the working area of the fume hood cannot be obtained in many laboratories with a single door panel which moves vertically upward.

And still a further problem associated with the prior art fume hoods is that in some circumstances, it is desirable to adjust the size of the bypass opening due to particular venting needs or changes in laboratory conditions.

SUMMARY OF THE INVENTION

It is therefore a primary object of the present invention to provide a fume hood having a door assembly which interacts more effectively with the bypass located on the face of the fume hood above the working area. Another important object is to provide a fume hood having a door assembly which can be moved to a fully open position without interfering with the ceiling in a laboratory.

To these ends, an object is to provide such a door assembly which comprises at least two door panels that move in unison between the closed and open positions. More specifically, it is an object to provide a split sash comprising two door panels which move in unison in a generally vertical direction. It is also an object that when the two doors close the opening to the working area, one of the doors is in a lower horizontal plane than the other door. Further, it is an object that when the split sash is moved towards the open position, the door disposed in the lower plane moves upwardly at a faster rate than the other door. Even more specifically, it is an object to provide such a door assembly in which the upper door moves toward the open position at generally half the rate of the lower panel.

And still a further object is to provide a bypass having an opening formed in the face of the cabinet of the fume hood for controlling the face velocity of the cabinet, and a closure apparatus for selectively adjusting the size of the bypass opening. Also an object is to provide such a closure apparatus which provides for easy adjustment of the opening of the bypass. Another object is to provide such a closure apparatus comprising a limited number of interacting parts to minimize breakdown of the closure apparatus.

To accomplish these and other related objects of the invention, in one aspect, the invention is related to a fume hood which comprises a cabinet, a vent, and a split sash. The cabinet defines a working area and has an opening for providing access to the working area. The vent is adapted to couple to an exhaust system for creating a face velocity across the opening to the working area to draw fumes through the vent away from the cabinet.

The split sash is also coupled to the cabinet for selectively opening and closing the opening to the working area of the cabinet. The split sash comprises at least two panels that move in unison between a closed position and open positions. In a preferred embodiment, the split sash comprises a first panel and second panel coupled together to move in unison in a generally vertical direction. The first panel is generally disposed in a lower vertical plane than the second panel, and the two panels are preferably coupled together by a pulley and cable system. The pulley and cable system includes means for moving the first panel upwardly at a faster rate than the second panel, and preferably, at generally twice the rate.

In another aspect, the fume hood also comprises a bypass having an opening formed in the face of the cabinet for controlling the face velocity of the cabinet and a closure apparatus for selectively adjusting the size of the bypass opening. More specifically, the closure apparatus comprises a plate which is movably mounted to the face of the cabinet adjacent to the bypass opening, and further comprises means for securing the plate in a fixed vertical position so that the plate can be fixedly moved to adjust the size of the bypass opening among fully open, fully closed, and partially open positions. The securing means preferably comprises at least two holes formed in the face of the cabinet, corresponding vertical slots formed in the plate, and weld studs and nuts for securing the plate in a desired vertical position.

Thus, it can be seen that the fume hood of the present invention provides improved control over the face velocity of the fume hood. The split sash door assembly can be moved from the closed position toward the fully open position without blocking off the bypass opening as quickly as with prior art single door panel assemblies. Further, the pulley and cable system reduces the force necessary to move the door assembly between the open and closed positions. Moreover, the split sash arrangement disclosed herein allows the door assembly to be moved from the closed to the fully open position without interfering with the ceiling in a laboratory because the door assembly only moves upwardly at half the vertical distance of a single panel prior art door. Also, the adjustable bypass disclosed herein provides greater control over the face velocity of the fume hood to accommodate for varying laboratory conditions.

BRIEF DESCRIPTION OF THE DRAWINGS

In the accompanying drawings which form a part of the specification and are to be read in conjunction therewith and in which like reference numerals are used to indicate like parts in the various views.

DESCRIPTION OF THE PREFERRED EMBODIMENT

Figure 1:
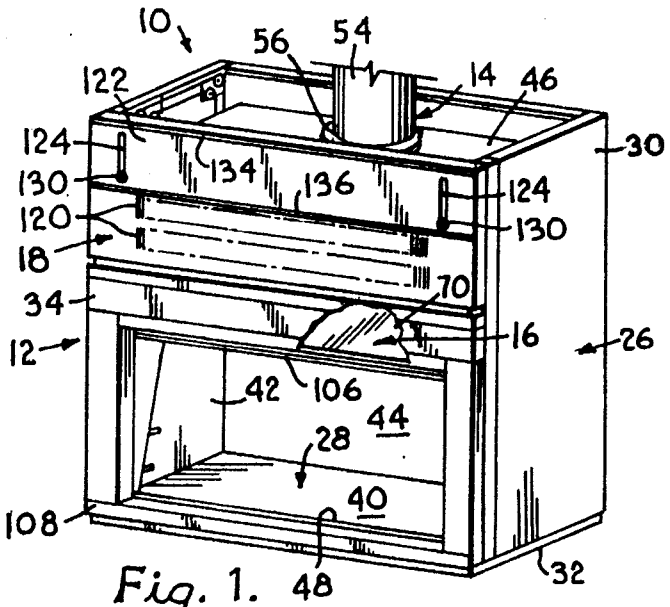
FIG. 1 is a fragmentary, perspective view of the fume hood of the present invention, showing the split sash in the fully open position and the adjustable bypass in the fully open position.

Referring initially to FIG. 1, the fume hood of the present invention is generally designated 10. The fume hood comprises a cabinet 12, a venting system 14, and a split sash 16 (shown better in FIG. 2). In another aspect of the invention, the fume hood 10 further comprises an adjustable bypass 18.

Referring to FIG. 1, the cabinet 12 comprises an outside housing 26 and an inner working area 28. The housing 26 comprises outer side walls 30, bottom wall 32, front face 34, and outer back wall 36. The working area 28 generally comprises a bottom wall 40, side walls 42, back wall 44, and top wall 46, all of which define an opening 48 to the working area 28.

Figure 9:
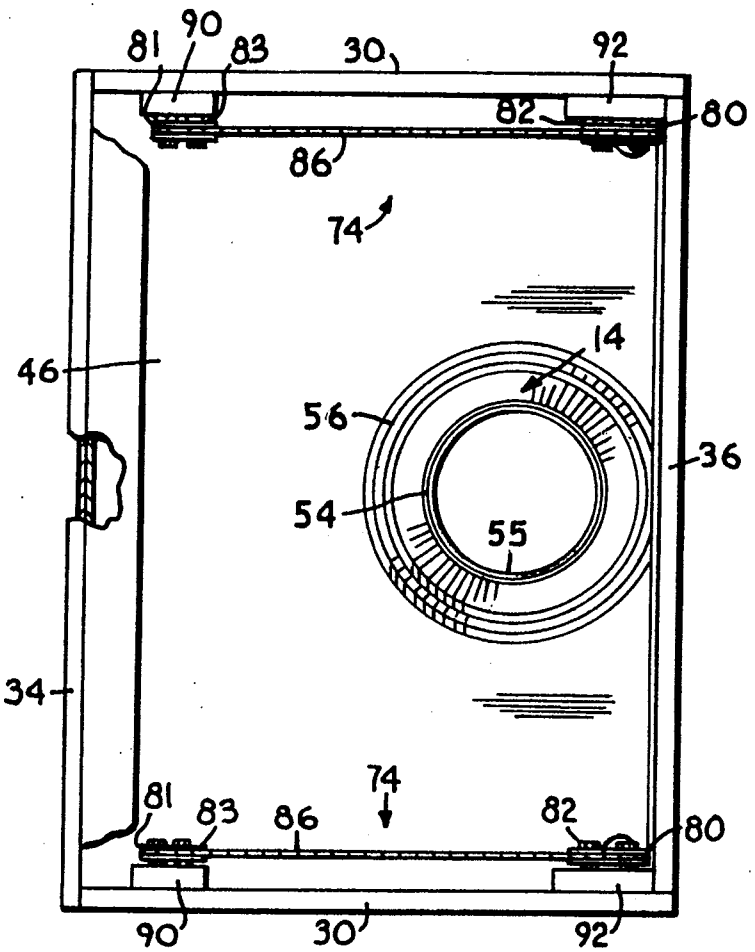
FIG. 9 is a top plan view of the fume hood.

Referring to FIG. 9, the venting system 14 generally includes an exhaust fan 54 (only the housing shown). The exhaust fan 54 draws fumes from the working area 28 of the cabinet 12, thereby creating a face velocity across the opening 48 to direct fumes away from the fume hood 10. The exhaust fan 54 has an opening 55 (shown in FIG. 9) which is formed in the top wall 46. The exhaust fan 54 draws fumes accumulated in the working area 28 through the opening 55 to an outdoor area or other controlled enclosure. Such venting systems for fume hoods are well known in the art, and will not be described further herein.

Figures 5, 6, 7:
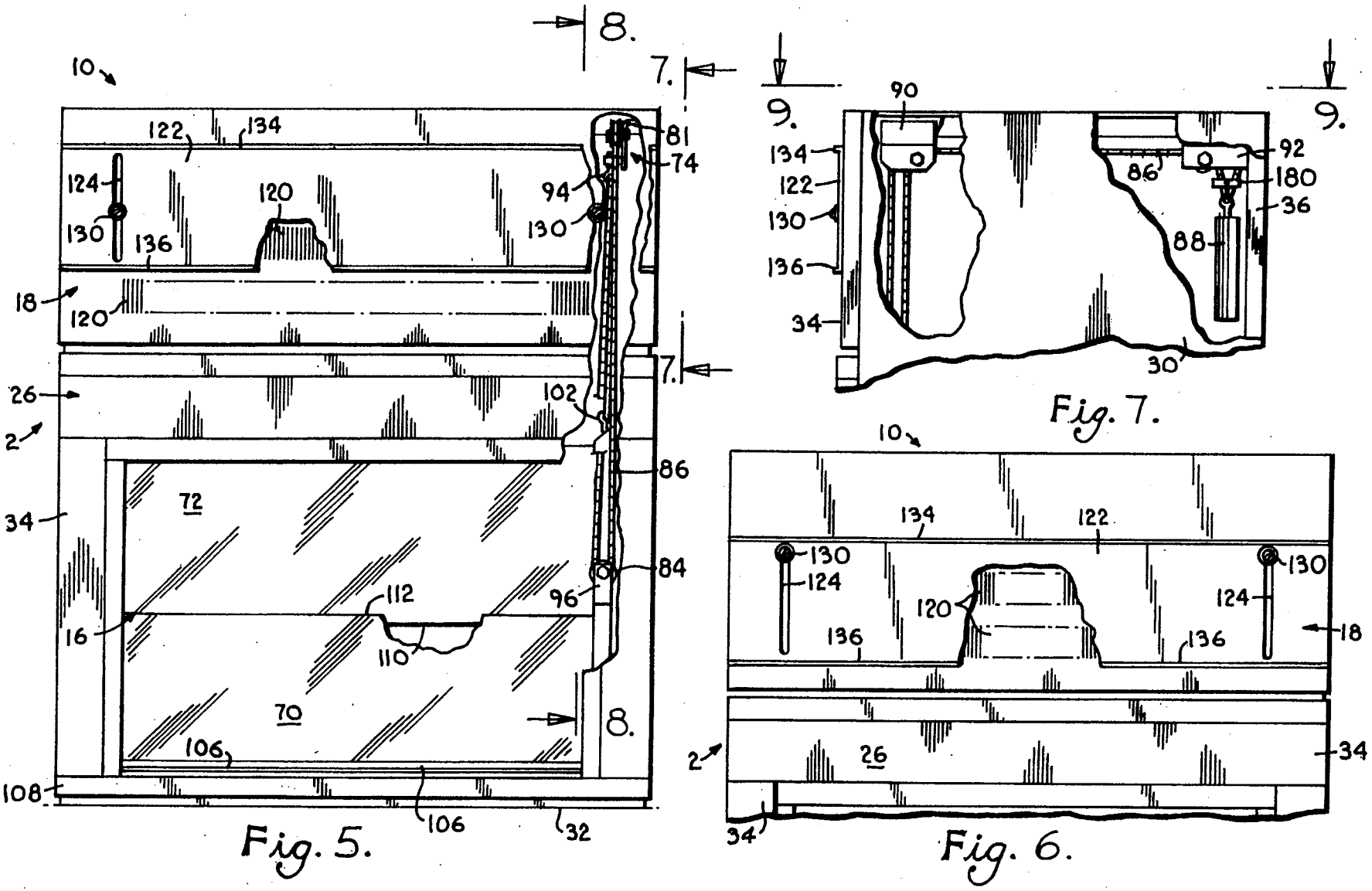
FIG. 5 is a front elevational view of the fume hood, showing the adjustable bypass in the half open position and the split sash in the closed position, as well as showing a breakaway view of part of the pulley system.
FIG. 6 is a fragmentary, front elevational view of the adjustable bypass in the fully closed position.
FIG. 7 is a fragmentary, side cross-sectional view taken generally along the plane of line 7—7 of FIG. 5 in the direction of the arrows, showing a breakaway view of the pulley system.
Figure 8:
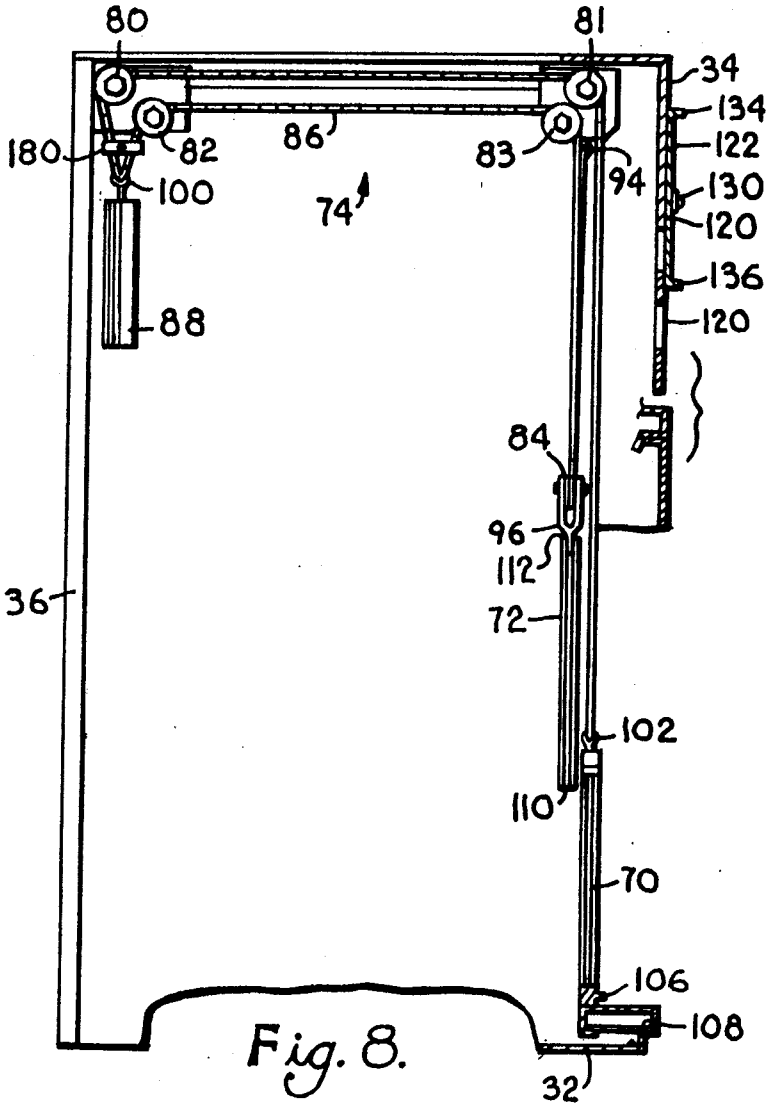
FIG. 8 is a side cross-sectional view taken generally along the plane of line 8—8 of FIG. 5 in the direction of the arrows, showing the cable and pulley system for the split sash.

The split sash 16 provides selective access to the working area 28 by allowing selective opening and closing of the opening 48 to the working area 28. The split sash is movable among a closed position (shown in FIG. 5), a fully open position (shown in FIG. 1), and partially open positions (one such position being shown in FIG. 2). The split sash 16 preferably comprises a first panel 70 and a second panel 72. The first panel 70 and second panel 72 are coupled together by a pulley and cable system, generally designated 74, which causes the first and second panels to move in unison, as will be described in greater detail below. The pulley system 74 is best shown in FIGS. 8 and 9. FIG. 8 shows the pulley arrangement which secures between each outer side wall 30 and each corresponding side of the first panel 70 and second panel 72. FIG. 9 shows that there is a pulley arrangement corresponding to each outer side wall 30.

Referring to FIG. 8, the pulley arrangement corresponding to each side generally comprises five pulleys 80, 81, 82, 83, and 84, a cable 86, and a counterweight 88. Opposing brackets 90 and 92 are secured to the side walls 30 for mounting the pulleys 81 and 83, and the pulleys 80 and 82, respectively.

Referring to FIG. 8, an eyebolt 94 is secured to the bottom of bracket 90. One end of cable 86 secures to the eyelet of eyebolt 94. The cable 86 extends from the eyebolt 94 and is trained under pulley 84 which secures to the second panel 72 by bracket 96. The cable 86 extends from pulley 84 to pulley 83. The cable 86 is trained over pulley 83 and extends to pulley 82. The cable is trained over pulley 82 through the eyelet of an eyebolt 100 which secures to the counterweight 88. The cable 86 extends through the eyelet of eyebolt 100 to the pulley 80. The cable is trained over pulley 80 to pulley 81. The cable is trained over pulley 81 to eyebolt 102, which secures to the first panel 70.

As stated above, the above-described pulley arrangement is coupled between each side wall 30 and each side of each of the first and second panels 70 and 72, respectively. Thus, an eyebolt 102 secures to each side of first panel 70. Further, a bracket 96 secures a pulley 84 to each side of the second panel 72. The pulley system 74 therefore symmetrically raises the first and second panels 70 and 72, respectively.

Figure 2:
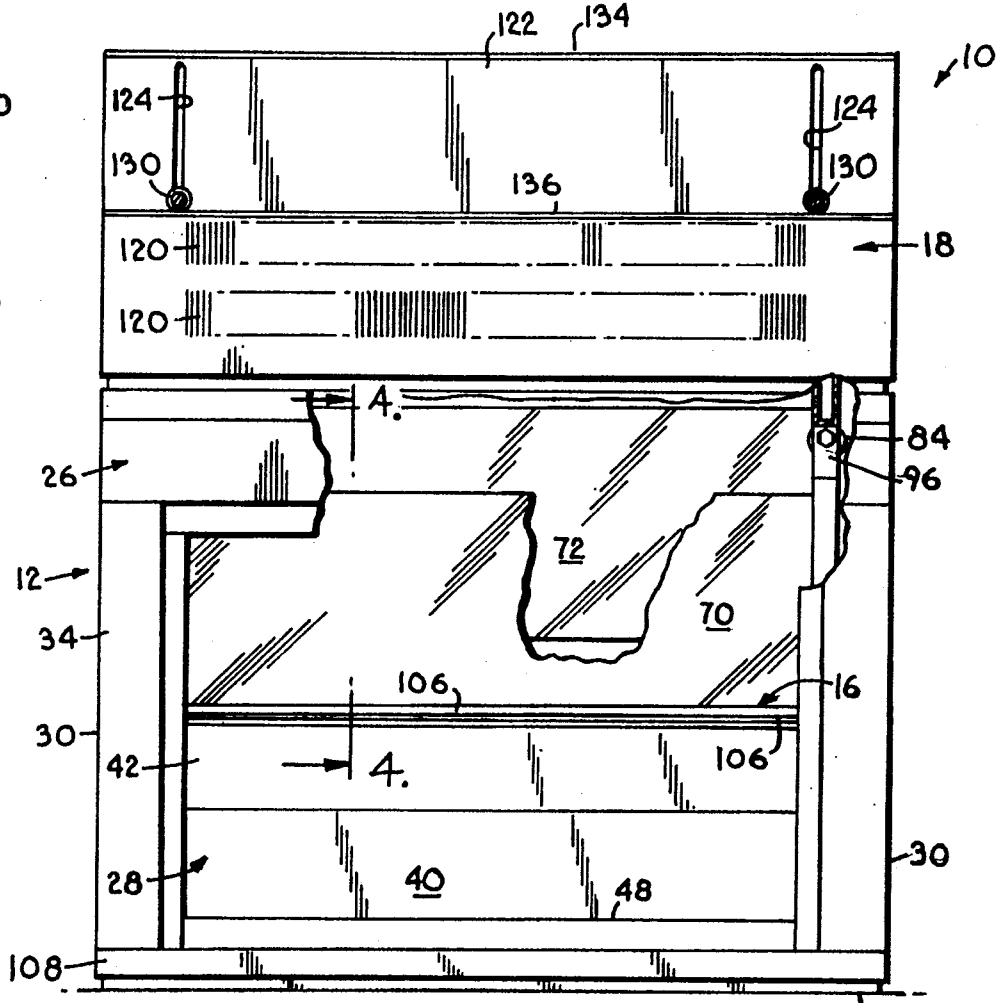
FIG. 2 is a front elevational view of the fume hood, showing the adjustable bypass in the fully open position and the split sash in a generally half open position.

The first panel 70 further includes a handle 106 which secures to the first panel 70 along the bottom edge of the first panel, as shown in FIG. 2. When the split sash 16 is in the fully closed position, the handle 106 abuts a sill 108 which attaches to the bottom wall 32 of cabinet 12, as shown in FIG. 8. The handle 106 facilitates moving of the split sash 16 between the closed position and open positions. The counterweights 88 should be of sufficient weight to balance the split sash 16 to maintain the split sash in a desired open position, as is well known in the art.

When the handle 106 is used to move the first panel 70 upwardly, the counterweights 88 automatically move downwardly, and thus automatically cause the second panel 72 to move upwardly. The eyebolt 94 and the pulleys 83 and 84 secure to each side of panel 72, as described above, and cause the second panel 72 to move upwardly at generally half the rate of the first panel 70.

Figure 3:
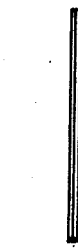
FIG. 3 is a side cross-sectional view showing the first and second panels of the split sash in the fully open position.
Figure 4:
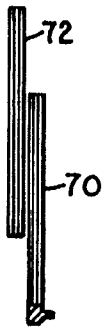
FIG. 4 is a side cross-sectional view taken generally along the plane of line 4—4 of FIG. 2 in the direction of the arrows, and showing the first and second panels of the split sash in a generally half open position.

FIGS. 3, 4, and 8 show the effect of the of the pulley and cable system with respect to the upward movement of the first and second panels. Referring initially to FIG. 8, when the split sash 16 is in the fully closed position (also shown in FIG. 5), the first panel 70 is generally disposed in a vertical plane lower than that of the second panel 72. There is, however, a slight vertical overlap defined between points 110 and 112 to allow for total closure of the opening 48 of fume hood 10 (as shown in FIG. 5). As the first panel 70 is moved upwardly via handle 106, the size of the overlap increases (as shown in FIG. 4) because the first panel 70 is moving upwardly at twice the rate of the second panel 72. FIG. 3 shows the split sash 16 in the fully open position. In this position, the first panel 70 and second panel 72 are substantially completely overlapped, thereby essentially forming a door panel having a height equivalent to half of the height of the opening 48 of fume hood 10. As shown in FIG. 1, when the split sash 16 is moved to the fully open position, neither panel 70 nor 72 raises above the top of the cabinet 12. More importantly, because the second panel 72 moves, upwardly at half the rate of the first panel 70, the bypass 18 does not get blocked off as quickly as with prior art single panel fume hood doors when the split sash is moved from the fully closed toward the fully open position.

In sum, by virtue of the fact that there is a single length of cable 86 trained over pulleys 80 and 81 between weight 88 and lower panel 70 this panel will move in a 1:1 ratio with weight 88. That is, movement of the weight a given distance will result in movement of panel 70 a corresponding distance. On the other hand, by virtue of the fact that the length of cable between weight 88 and upper panel 72 extends around pulley 84 in a double loop, this panel will move in a 1:2 ratio with weight 88. That is, movement of the weight a given distance will result in movement of panel 72 one-half of that distance. Also, because of the mechanical advantage resulting from the cable being double looped around pulley 84, it requires only half the weight to counterbalance panel 72 as it does to counterbalance upper panel 70 of the same weight.

Referring to FIG. 1, in another aspect of the invention, the adjustable bypass 18 is formed in the upper portion of the front face 34 of cabinet 12 to provide better control over the face velocity of the fume hood 10. The adjustable bypass includes air vents 120. A plate 122 is movably mounted to the front face 34 of cabinet 12. The plate 122 comprises slots 124 which correspond to holes (not shown) formed in the face 34 of cabinet 12. Bolts 130 are adapted to be received through the slots 124 and the holes in the face 34 located above the top vent 120. Referring to FIGS. 1 and 2, when the plate 122 is in the fully open position, the bolts 130 are located at the bottom of the slots 124, and the plate 122 is fixedly secured above both air vents 120. In this position, the bypass opening is fully open. FIG. 5 shows the plate 122 covering one of the air vents 120, thereby generally reducing the size of the bypass opening by half. FIG. 6 shows the plate 122 secured in a position in which the bypass opening is closed. To move the plate between the various positions shown, the bolts 130 should be loosened, the plate should be moved to the desired position, and the bolts should be retightened to secure the plate 122 in the new desired position. The plate 122 further comprises a top ridge 134 and a bottom ridge 136 for facilitating movement of the plate 122 between the various positions, as best shown in FIG. 8.

ALTERNATIVE EMBODIMENT

Figure 12:
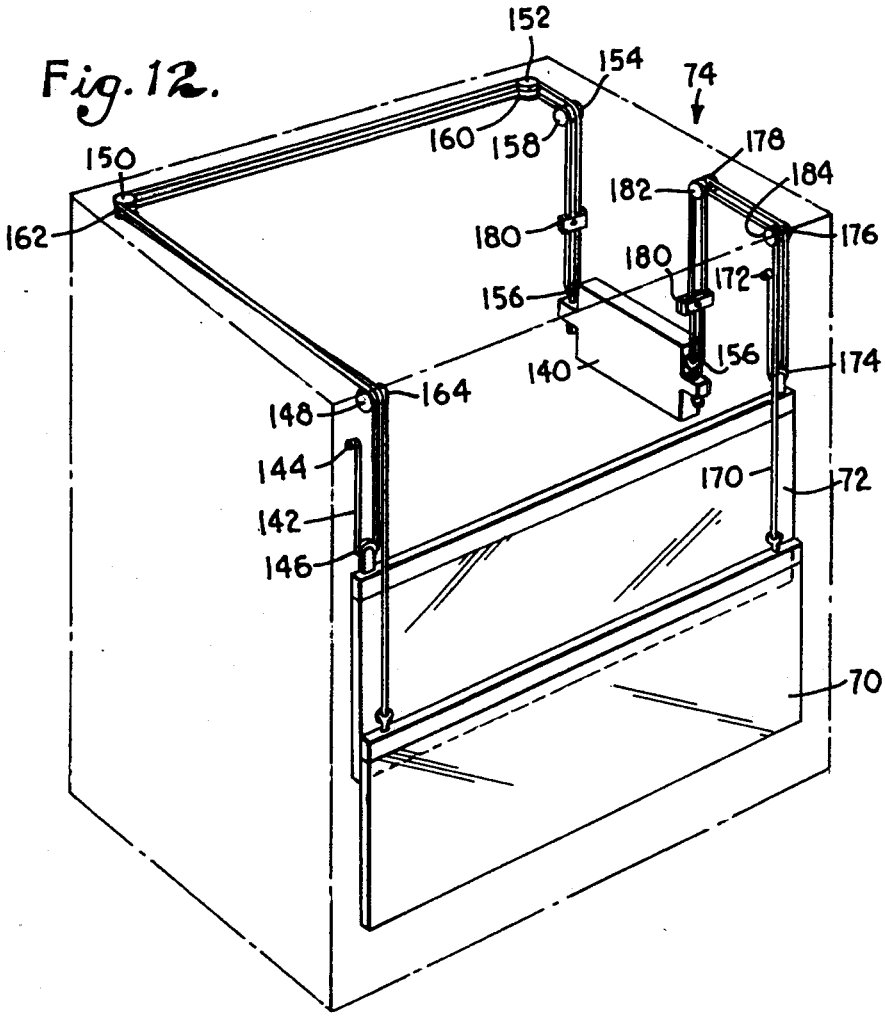
FIG. 12 is a perspective view of an alternative embodiment of the cable and pulley system for the split sash.

Referring to FIG. 12, in an alternative embodiment, the pulley and cable system 74 is modified to use only one counterweight 140. This arrangement has been found to provide smoother upward movement of the first and second panels 70 and 72, respectively. Because the operation of this alternative pulley arrangement is virtually identical to the embodiment described above, it will only be described briefly. A cable 142 extends from eyebolt 144 over pulleys 146 (secured to second panel 72), 148, 150, 152, and 154, and through eyebolt 156, which is secured to counterweight 140. Cable 142 extends from eyebolt 156 over corresponding pulleys 158, 160, 162, and 164, and is secured to the first panel 70 as described above. Similarly, cable 170 extends from eyebolt 172 over pulleys 174, 176, and 178, and through a corresponding eyebolt 156, which is secured to counterweight 140. Cable 170 extends from eyebolt 156 over corresponding pulleys 182 and 184 and is secured to the first panel 70. Further, the cables 142 and 170 are clamped by clamps 180, respectively. The clamps prevent the cables from slipping out of synchronization. Thus, as described above, when the first panel is raised, the second panel 72 moves upwardly with the first panel at half the rate.

Figure 10:
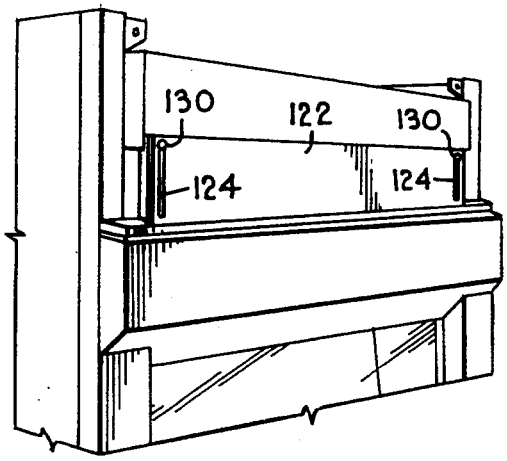
FIG. 10 is a perspective view of an alternative embodiment of the adjustable bypass, showing the bypass in the closed position.
Figure 11:
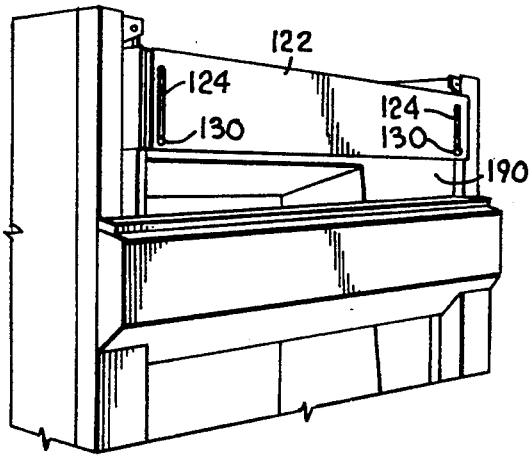
FIG. 11 is a view similar to FIG. 10, showing the bypass in the fully open position.

Also, in this alternative embodiment, the adjustable bypass 18 is modified as shown in FIGS. 10–11. The air vents 120 are eliminated in this embodiment. An opening 190 is provided across the face of the fume hood instead of the vents to increase the air flow through the bypass at each position. The plate 122 is still movably mounted to allow for selective opening and closing of opening 190. FIG. 10 shows bypass 18 in the fully closed position, and FIG. 11 shows the bypass in the fully open position. As described above, the particular position in which the bypass is secured is determined by laboratory or working conditions, as is well known in the art.

OPERATION

In operation, the face velocity of the fume hood 10 can be more accurately controlled by providing selective closure of the bypass opening formed by air vents 120, and by providing superior interaction between the fume hood door, i.e., the split sash 16, and the bypass 18.

As described above, the bypass opening can be adjusted by loosening bolts 130, sliding plate 122 along slots 124 to the desired position, and retightening bolts 130, thereby securing the plate 122 in a fixed position.

To selectively open the opening 48 to working area 28, handle 106 is preferably held and moved to the desired position. Counterweights 88 (counterweight 140 in the alternative embodiment) maintain the split sash 16 in any desired open position. As the handle 106 is moved upwardly, the first or lower panel 70 is moved upwardly at generally twice the rate of speed of the second or upper panel 72. Thus, for a given movement of lower panel 70, the upper panel will move only one-half as far. Not only does this arrangement prevent early closure of the bypass opening formed by vents 120, but it also reduces by half the height of the fume hood door which is necessary to fully close the opening 48 of working area 28.

From the foregoing, it will-be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A fume hood comprising:

a cabinet defining a working area, the cabinet having a front face, the front face having an opening for providing access to said working area;

means for directing fumes that collect in said working area away from said cabinet, the directing means being adapted to couple to an exhaust system for creating a face velocity across the face of the fume hood to vent fumes that collect in said working area;

an adjustable bypass comprising a bypass opening formed in the face of said cabinet and means for selectively adjusting the size of the bypass opening comprising a plate movably mounted to the face of said cabinet adjacent to the bypass opening and means for securing the plate in a fixed vertical position comprising at least two holes formed in the face of said cabinet, corresponding vertical slots formed in the plate, and bolts for securing the plate in a desired vertical position, so that the plate can be movably adjusted to adjust the vertical size of the bypass opening among fully open, fully closed, and partially open positions; and a split sash comprising a first panel and a second panel coupled together to move in unison in a generally vertical direction for selectively opening the opening to said working area of said cabinet, wherein said first panel is generally disposed in a lower horizontal position than said second panel, and wherein said first and second panels are coupled together and to said cabinet by a pulley and cable system comprising means for moving said first panel upwardly at a faster rate of speed than said second panel.

2. The fume hood of claim 1 wherein the cable and pulley system comprises means for moving said first panel upwardly at generally twice the rate of speed of said second panel.

3. A fume hood comprising:

a cabinet defining a working area, the cabinet having an opening for providing access to the working area;

means for directing fumes that collect in said working area away from said cabinet; and a split sash comprising a first and a second panel that are coupled by a pulley and cable system to one another and to said cabinet and that move in unison in the same general vertical direction to selectively open and close the opening to said working area, wherein said first panel is generally disposed in a lower horizontal position than said second panel and said pulley and cable system comprises means for moving said first panel upwardly at a faster rate of speed than said second panel.

4. The fume hood of claim 3 wherein said moving means moves said first panel upwardly at approximately twice the rate of speed of said second panel.

5. The fume hood of claim 4 wherein the fume hood further comprises an adjustable bypass coupled to the cabinet.

6. The fume hood of claim 5 wherein the adjustable bypass is coupled to the cabinet above the opening of the cabinet in generally the same vertical plane.

7. A fume hood comprising:

a cabinet defining a working area, the cabinet having an opening for providing access to the working area;

means for directing fumes that collect in said working area away from said cabinet;

a split sash comprising a first panel and a second panel disposed in generally parallel vertical planes, said first panel being disposed in a generally lower horizontal position than said second panel when said first and second panels are both moved downwardly to fully close the opening to said working area, and said first and second panels being disposed in generally the same horizontal position when said first and second panels are both moved upwardly to fully open the opening to said working area; and a cable and pulley system for connecting the two panels together, said system comprising means for moving said first panel upwardly at a faster rate of speed than said second panel.

8. The fume hood of claim 7 wherein said moving means moves said first panel upwardly at generally twice the rate of speed of said second panel.

* * * * *